United States Patent [19]

Nagamoto et al.

[11] Patent Number: 4,514,711

[45] Date of Patent: Apr. 30, 1985

[54] AC DRIVE ELECTROMAGNETIC RELAY

[75] Inventors: Mitsuki Nagamoto, Tsu; Takuo Kubota, Ise, both of Japan

[73] Assignee: Matsushita Electric Works, Ltd., Osaka, Japan

[21] Appl. No.: 636,030

[22] Filed: Jul. 30, 1984

[30] Foreign Application Priority Data

Jul. 30, 1983 [JP] Japan ..... 58-139631

[51] Int. Cl.[3] ..... H01F 7/10

[52] U.S. Cl. ..... 335/243; 335/245; 335/274

[58] Field of Search ..... 335/128, 243, 245, 249, 335/270, 274, 276, 279

[56] References Cited

U.S. PATENT DOCUMENTS 2,918,611 12/1959 Pettersson et al. ..... 335/276
3,701,066 10/1972 Bosch et al. ..... 335/279 X
3,953,814 4/1976 Kuipers ..... 335/274 X

*Primary Examiner*—George Harris
*Attorney, Agent, or Firm*—Koda and Androlia

[57] ABSTRACT

An AC current electromagnetic relay is disclosed herein. The relay comprises a U-shaped armature with arms connected by a web and a generally E-shaped yoke with an elongated center leg and shortened side legs extending from a common base, the elongated center leg serving as a core around which a coil and a shading ring are disposed. The U-shaped armature is placed on the yoke with the free end edges of the arms being pivotally supported on the respective side legs of the yoke, so that upon the energization of the coil the armature is pulled toward the yoke and abuts against the respective free end portions of the side legs and the center leg, such free end portions being cooperative to define apexes of a triangle. Thus, a three-point contact can be attained between the armature and the yoke. With this arrangement of the three-point contact, the armature is allowed to abut simultaneously against all the three contacting faces at the free end portions of the respective legs, even if these contacting faces are out of exact alignment in the same plane, whereby effecting stable contact between the armature and the yoke. Accordingly, the relay can assure stable and intimate contact of the armature with the yoke for preventing chattering and beating at the time of energizing the coil, while allowing the employment of the yoke having possible misalignment of the contacting faces at the free end portions of yoke.

7 Claims, 12 Drawing Figures

AC DRIVE ELECTROMAGNETIC RELAY

BACKGROUND OF THE INVENTION

1. Field of the Invention

The present invention is directed to an AC current electromagnetic relay, more particularly, to an AC current electromagnetic relay with a flat pivoting armature and a generally E-shaped yoke.

2. Description of the Prior Art

Electromagnetic relays with a flat pivoting armature and a generally E-shaped yoke are known, for example, as disclosed in U.S. Pat. No. 3,553,729. In the relay, a U-shaped flat armature is pivotally supported on an E-shaped yoke having center and side legs of equal length so as to complete the magnetic circuit with a coil disposed around the center leg serving as a core. The U-shaped armature having a pair of parallel arms connected by a web is placed on the yoke with the free end edges of the arms pivoted on the side legs at the intermediate portions along its length, so that upon the energization of the coil the armature is pulled toward the yoke surface to be in set position where it is in parallel with the yoke surface to have the web brought in abutting contact with the free end portions of the respective ones of the three legs of the yoke. In the meanwhile, the E-shaped armature is difficult to be formed into accurate configuration in which the free end portions of the respective legs are positioned exactly in the same plane and thus frequently suffers the misalignment in the direction perpendicular to the yoke surface. In view of the fact that the contacting portions of the legs with the yoke is arranged in a line, such misalignment will certainly lead to unstable contacting engagement between the armature and the yoke, rendering the armature to chatter and therefore unstable contacting operation. This is particularly disadvantageous when the relay is to be driven by AC current since the above unstable or uncertain contacting engagement between the armature and the yoke is very susceptible to fluctuation of magnetic flux in the yoke, although the fluctuation being reduced to a minimum by a suitable shading ring used around the core, so that the armature will chatter at the time of energizing the coil to produce unacceptable beating action.

SUMMARY OF THE INVENTION

The above disadvantage has been eliminated by the present invention which employs a generally E-shaped flat yoke with an elongated center leg and shortened side legs extending from a common base. Disposed around the center leg serving as a core are a coil and a shading ring. A U-shaped armature with a pair of arms connected by a web is placed upon the yoke with the free end edges of the arms being pivotally supported on the respective side legs of the yoke, so that upon the energization of the coil the armature is pulled toward the yoke to have its web and arms in abutting contact with the faces at the free end portions of the respective three legs of the yoke. The contacting faces at the free end portions of the respective legs are cooperative to define apexes of a triangle, whereby three-point contact can be attained between the armature and the yoke. With this arrangement of the three-point contact, the armature is allowed to abut simultaneously against all the three contacting faces of the legs, even if these contacting faces are out of exact alignment in the same plane, thus effecting stable contact between the armature and the yoke and therefore between electric switching contacts irrespective of the planer misalignment of the contacting faces at the free end portions of the legs, such misalignment being mostly possible in forming the yoke into the E-shaped configuration and is difficult to be avoided with usual forming procedure. With the result of this, the relay can assure stable and intimate contact of the armature with the yoke for preventing chattering and beating at the time of energizing the coil, while allowing the employment of the yoke having possible misalignment of the contacting faces at the free end portions of the three legs.

Accordingly, it is a primary object of the present invention to provide an AC current electromagnetic relay which is free from chatter and beat so as to present a stable contacting operation without requiring a higher accuracy for the yoke configuration.

In a preferred embodiment of the present invention, the yoke is made of two identical laminations of said generally E-shaped configuration with elongated center leg members for the purpose of reducing undesirably eddy currents. These center leg members are together inserted into the shading ring to be clamped thereby so as to constitute the center leg of the yoke. Therefore, the yoke can be easily assembled by better utilization of the shading ring. Said shading ring is positioned immediately below the contacting portion of the center leg with the web of the armature and the web is provided with an opening into which the portion of the shading ring extends when the armature is pulled toward the yoke, so that the shading ring can be successfully received in the space left between the free end portions of the side legs and the free end portion of the elongated center leg without disturbing the movement of the armature. This enables the better utilization of the space resulting from the elongated center leg for incorporating the shading ring.

It is therefore another object of the present invention to provide an AC current electromagnetic relay which gives rise to a compact arrangement.

The present invention discloses in several preferred embodiments and modifications other advantageous features for mounting the shading ring around the elongated center leg or the core of the yoke.

These and still other objects of the present invention will be more apparent in the following detailed description of the preferred embodiment when taken in conjunction with the attached drawings.

DETAILED DESCRIPTION OF THE EMBODIMENTS

Figure 1:
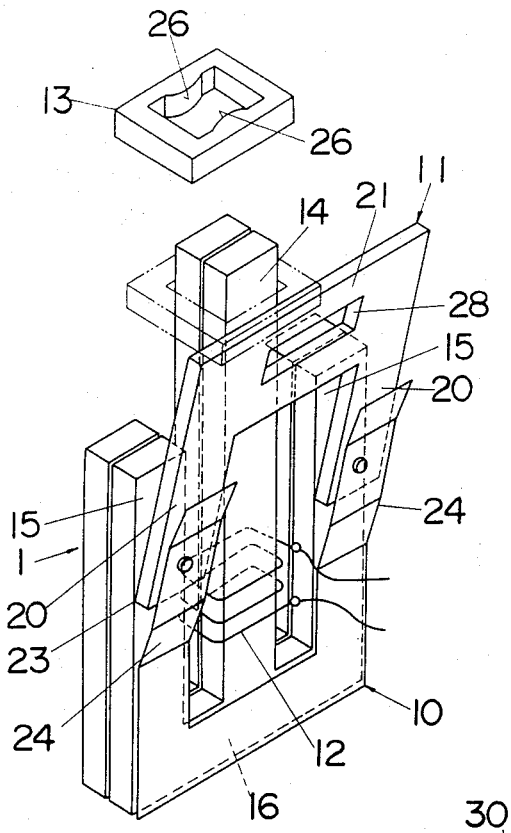
FIG. 1 is a perspective view somewhat in schematic representation of the principal portion of an AC current electromagnetic relay in accordance with a first embodiment of the present invention.
Figure 2:
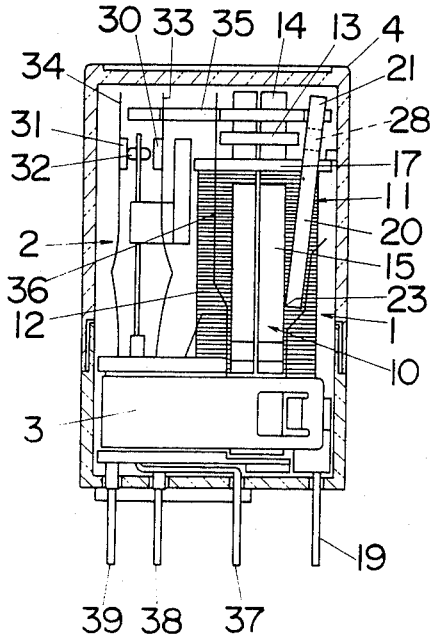
FIG. 2 is an front view of the above relay with a case in cross section.
Figure 3:
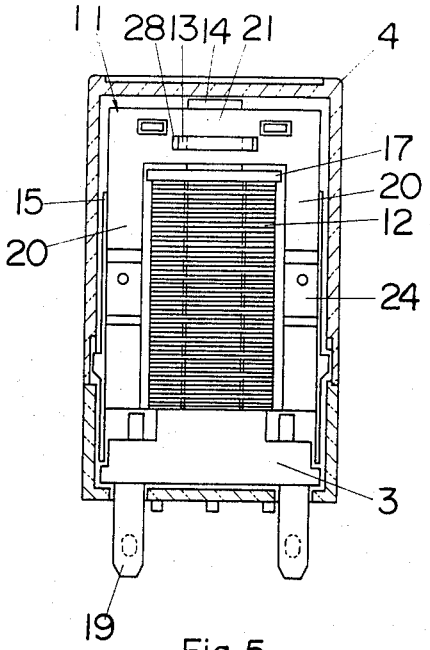
FIG. 3 is a side view of the above relay with the case in cross section.

Referring now to FIGS. 1 to 3, there is shown an AC current electromagnetic relay in accordance with a first preferred embodiment of the present invention. The relay includes an electromagnetic assembly 1 and a switching contact assembly 2 both carried on a header 3 of electrically insulating material and a case 4 enclosing the assemblies and the header 3. The electromagnetic assembly 1 comprises a yoke 10, a flat armature 11, a coil 12, and a shading ring 13. The yoke 10 is formed into a generally E-shaped configuration with an elongated center leg 14 and shortened side legs 15 extending from a common base 16 in the the same plane, and is supported vertically on header 3 by securing the base 16 thereto. Said elongated center leg 14 serves as a core around which a coil bobbin 17 carrying the coil 12 and the shading ring 13 are disposed. The coil 12 is connected by lead wires to coil terminals 19 extending through the header 3 for being driven by an external AC voltage connected thereto.

Cooperative with the yoke 10 is the armature 11 which is of generally U-shaped configuration with a pair of arms 20 connected by a web 21 and is placed upon one surface of the yoke 10 with the lower end edges 23 of the arms 20 being pivotally supported on the corresponding side legs 15 of the yoke by means of a bearing spring 24, whereby the armature 11 is movable between a set position where it is in a plane parallel with the plane of the yoke 10 and a reset position where it is in a plane at a slight angle with respect to the plane of the yoke 10. The lower or free end edges 23 of the arms 20 are pivoted on the side legs 15 at the intermediate portions along the length thereof so that the armature in the set position have its arms 20 and the web 21 in abutting contact with the free end portions of the side legs 15 and the center leg 14, respectively. In this respect, since these free end portions or the contacting faces of the respective legs 14 and 15 are arranged in a plane and cooperative to define apexes of a triangle, the armature 11 when drawn into the set position upon energization of the coil 12 abuts in a three-point contact manner against the yoke 10. This allows secure and simultaneous contacts of the armature 11 with the yoke 10 at the above apexes of the triangle, even if there be a possible misalignment between the surfaces of the center leg 14 and the side legs 20, thereby assuring the reliable operation of the armature free from chattering and beating, which would be otherwise likely to occur when the armature fails to have simultaneous contacts with all the contacting faces of the legs of the yoke.

Figure 4:
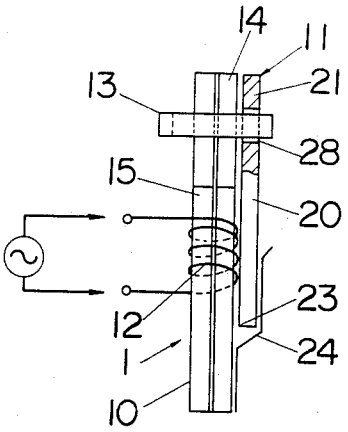
FIG. 4 is a schematic view of the above relay at its set position for the purpose of only showing the relative position of an armature with respect to a yoke.

Said shading ring 13 is shaped in the form of a rectangular frame with a pair of protrusions 26 on its opposite inner sides and is placed around said center leg 14 with its protrusions 26 pressing thereagainst at the upper or free end portion of the center leg 14. Formed in the web 21 of the armature 11 is an escape opening 28 through which the portion of the shading ring 13 extends when the armature 11 is in said set position, so that the shading ring 3 does not disturb the operation of the armature 11, as shown in FIG. 4. In the present embodiment, the yoke 10 is composed of identically shaped laminations struck from a ferromagnetic plate and insulated with one another for reducing eddy currents, and said shading ring 13 serves additionally to clamp the center leg members of the laminations extending therethrough for a reinforcing purpose.

Said switching contact assembly 2 includes at least one combination of a normally open movable contact 30, a normally closed movable contact 31 and a common fixed contact 32, each formed on one of contact members secured at the lower ends to the header 3 and connected each to one of terminal pins 37, 38 and 39 extending downwardly through the header 3. Also included in the switching contact assembly 2 is a card 35 of electrically insulating material which extends horizontally between the web 21 of the armature and the contact members 33 and 34 carrying the movable contacts 30 and 31 for operatively interconnecting the armature 11 and the contact members 33 and 34 in such a way that when the armature 11 is moved in the set position the card 35 pushes the contact members 33 and 34 to bring the normally open contact 30 into contact engagement and at the same time bring the normally closed contact 31 out of contact engagement with the common contact 32. A restoring leaf spring 36 secured at its lower end to the header 3 biases the card 35 and the armature 11 in the direction of urging the armature 11 away from the yoke 10 or into the reset position.

Figure 5:
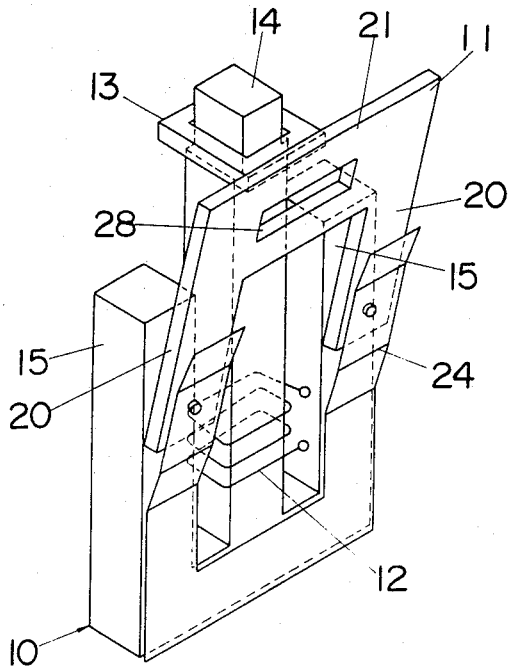
FIG. 5 is a perspective view somewhat in schematic representation of the principal portion of an AC current electromagnetic relay in accordance with a second embodiment of the present invention.
Figure 6:
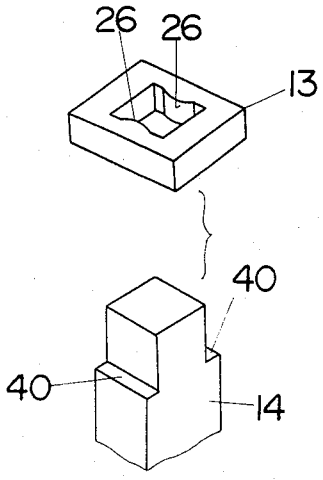
FIG. 6 is an exploded perspective view of a shading ring and a portion of the yoke employed in the relay of FIG. 5.

Referring to FIGS. 5 and 6, there is shown a second embodiment of the present invention which is similar to the above first embodiment except that the yoke 10 is made of single material struck from a suitable ferromagnetic plate and that the shading ring 13 rests on shoulders 40 formed on an elongated center leg 14 of the yoke 10. For clarity, the same numerals are employed for designating the same parts as in the first embodiment. This holds in the other embodiments and modifications subsequently described the constructions of which are similar to the second embodiment except the supporting constructions of the shading ring 13. In the second embodiment, the elongated center leg 14 of the yoke 10 is shaped to have a narrowed top end portion defining on its side faces adjacent the contacting face with the armature 11 said shoulder 40 on which the shading ring 13 is supported, providing easy positioning of the shading ring 13.

Figure 7:
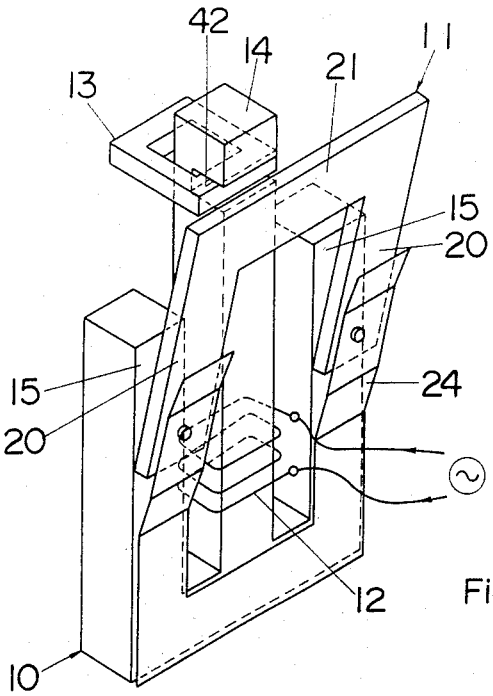
FIG. 7 is a perspective view somewhat in schematic representation of the principal portion of an AC current electromagnetic relay in accordance with a third embodiment of the present invention.
Figure 8:
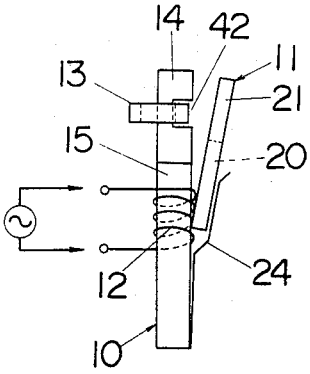
FIG. 8 is a schematic view of the relay of FIG. 7 at its reset position.

FIGS. 7 and 8 show a third embodiment of the present invention in which an elongated center leg 14 of the yoke 10 is provided in its contacting face at the upper end with a notch 42 for receiving one portion of the shading ring 13. With this arrangement, the shading ring 13 is prevented from projecting the contacting face of the center leg 14 so as not to disturb the operation of the armature 11 besides that it easily fits around the center leg 14.

Figure 9:
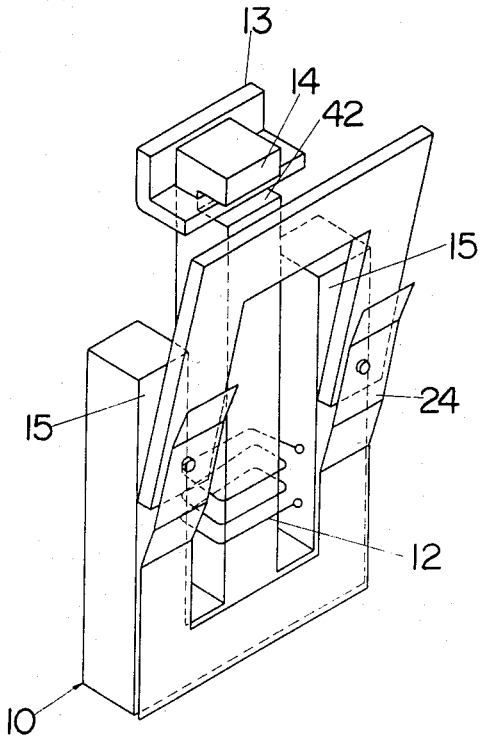
FIG. 9 is a perspective view somewhat in schematic representation of the principal portion of an AC current electromagnetic relay in accordance with a fourth embodiment of the present invention.
Figure 10:
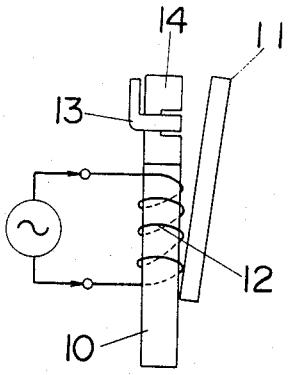
FIG. 10 is a schematic view of the relay of FIG. 9 at its reset position.

FIGS. 9 and 10 shows a fourth embodiment of the present invention which is similar to the third embodiment except that the projecting portion of the shading ring 13 on opposite face to said contacting face is bent longitudinally along the center leg 14. This allows the shading ring 13 to occupy less space with respect to the thickness of the yoke 10, giving rise to a compact arrangement of the electromagnetic assembly 1.

Figure 11:
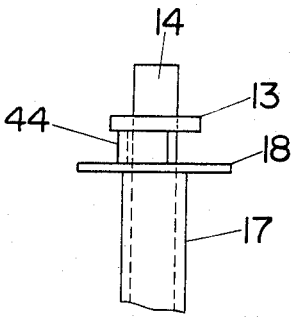
FIGS. 11 and 12 are respectively schematic views of modifications of the above embodiment showing the shading ring supported by a coil bobbin.
Figure 12:
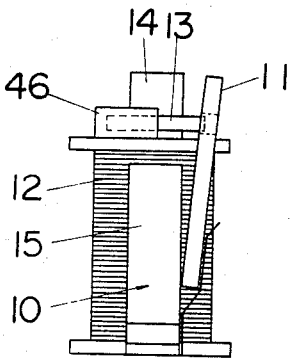

Shown in FIG. 11 is a modification of the first embodiment in which the shading ring 13 is supported by means of a spacer 44 on the upper flange 18 of the coil bobbin 17 for easy positioning of the shading ring 13. Also shown in FIG. 12 is another modification in which the shading ring 13 is inserted to a carrier 46 integrally formed on the upper flange 18 of the coil bobbin 17. Thus, the shading ring 13 can be securely held in place around the center leg 14 of the yoke 10 without requiring direct connection between the shading ring 13 and the center leg 14 of the yoke 10, eliminating the possibility of damaging the contacting surface and of distorting the center leg 14, which might otherwise occur during the fastening operation of the shading ring 13 directly onto the center leg 14.

What is claimed is:

1. An AC current electromagnetic relay comprising;

a yoke formed into a generally E-shaped configuration with an elongated center leg and shortened side legs extending from a common base so that the free end portions of the respective legs define apexes of a triangle;

a coil disposed around the center leg of the yoke;

a shading ring disposed around the center leg;

a generally U-shaped flat armature having a pair of parallel arms connected by a web and being mounted on one surface of the yoke in substantially parallel relationship therewith;

a switching contact assembly including at least one pair of contacts which cooperates with the armature to make and break the contacts;

bearing means by which said U-shaped armature is pivotally supported at the free end edges of the arms on the surface of the yoke with its arms partially overlapping on the side legs of the yoke and with its web confronting the free end portion of the center leg, whereby upon energization of the coil the armature is pulled toward the yoke to be in a set position where the arms and the web of the armature abut respectively with said free end portions of the center and side legs defining the apexes of the triangle so as to establish a three-point contact between the yoke and the armature; and biasing means for biasing the armature away from the yoke.

2. The AC current electromagnetic relay as set forth in claim 1, wherein the yoke is made of two identical laminations of said generally E-shaped configuration with elongated center leg members, said center leg members being inserted into the shading ring to be clamped thereby so as to form the center leg of the yoke, and wherein said shading ring is positioned adjacent the contacting portion of the center leg with the web of the armature and extends into an opening formed in the web of the armature when the armature is in the set position.

3. The AC current electromagnetic relay as set forth in claim 1, wherein the free end portion of the center leg of the yoke is formed on the opposite sides adjacet the contacting face against the web of the armature with shoulders upon which the shading ring is supported.

4. The AC current electromagnetic relay as set forth in claim 1, wherein the free end portion of the center leg of the yoke is formed in the contacting face against the web of the armature with a notch into which one peripheral portion of the shading ring is received so that the shading ring does not project on the contacting face of the center leg of the yoke.

5. The AC current electromagnetic relay as set forth in claim 4, wherein the opposite peripheral portion of the shading ring to the portion received in the notch is bent along the face opposite to the contacting face of the center leg of the yoke.

6. The AC current electromagnetic relay as set forth in claim 1, wherein said shading ring is supported by means of a spacer mounted on the flange of a coil bobbin of said coil disposed around the center leg of the yoke.

7. The AC current electromagnetic relay as set forth in claim 1, wherein said shading ring is supportedly inserted in a carrier integrally formed on the flange of a coil bobbin of said coil disposed around the center leg of the yoke.

* * * * *